US012768352B2

(12) United States Patent
Dambacher

(10) Patent No.: US 12,768,352 B2
(45) Date of Patent: Oct. 20, 2026

(54) SINUSOIDAL PUMP WITH BLOCKING SLIDE, AND PRODUCTION METHOD

(71) Applicant: Watson Marlow GmbH—MasoSine Division, Ilsfeld (DE)

(72) Inventor: Frank Dambacher, Ilsfeld (DE)

(73) Assignee: Watson Marlow GmbH—MasoSine Division, Ilsfeld (DE)

( * ) Notice: Subject to any disclaimer, the term of this patent is extended or adjusted under 35 U.S.C. 154(b) by 0 days.

(21) Appl. No.: 19/382,858

(22) Filed: Nov. 7, 2025

(65) Prior Publication Data

US 2026/0132788 A1 May 14, 2026

(30) Foreign Application Priority Data

Nov. 11, 2024 (DE) ..... 10 2024 132 849.5

(51) Int. Cl.
*F04C 15/06* (2006.01)

(52) U.S. Cl.
CPC ..... *F04C 15/06* (2013.01); *F04C 2230/23* (2013.01); *F04C 2240/20* (2013.01); *F04C 2240/30* (2013.01)

(58) Field of Classification Search
CPC .... F04C 2240/20; F04C 15/06; F04C 2/3568; F04C 2230/23; F04C 2240/30; F01C 21/10; F01C 21/0809; F01C 21/0881; F01C 21/108; F05C 2253/04
USPC ..... 418/52, 217, 229, 228, 216, 104, 220, 418/139, 92
See application file for complete search history.

(56) References Cited

U.S. PATENT DOCUMENTS 3,156,158 A * 11/1964 Pamplin ..... A61C 1/05 418/220
3,994,638 A * 11/1976 Garland ..... F04C 18/3568 417/310
4,093,408 A * 6/1978 Yamaguchi ..... F01C 1/3568 418/92

(Continued)

FOREIGN PATENT DOCUMENTS

DE 3418708 A1 11/1984
DE 20 2004 000 185 U1 4/2004
WO 2005/066501 A1 7/2005

OTHER PUBLICATIONS

German Office Action mailed Jul. 25, 2025 in corresponding German Patent Application No. 10 2024 132 849.5 (and English machine translation).

*Primary Examiner* — Mark A Laurenzi
*Assistant Examiner* — Benjamin Doyle
(74) *Attorney, Agent, or Firm* — Posz Law Group, PLC

(57) ABSTRACT

A blocking slide for a pump includes a rotor contact area designed to rest against a wave-shaped rotor collar of the pump, wherein the rotor contact area includes lateral rotor contact surfaces which are designed to rest in each case against side surfaces of the rotor collar, and an upper rotor contact surface which is designed to rest against a radially outward-facing shell surface of the rotor collar, wherein the lateral rotor contact surfaces are each implemented as conically rounded surfaces, wherein a first radius of curvature in a lower region of the lateral rotor contact surfaces, which is remote from the upper rotor contact surface, is smaller than a second radius of curvature in an upper region of the lateral rotor contact surfaces, which is adjacent to the upper rotor contact surface.

12 Claims, 5 Drawing Sheets

(56) References Cited

U.S. PATENT DOCUMENTS

| | | | | |
|---|---|---|---|---|
| 4,575,324 | A * | 3/1986 | Sommer | F01C 21/0809 418/217 |
| 2007/0292297 | A1* | 12/2007 | Fromm | F04C 2/3568 418/104 |
| 2018/0306183 | A1* | 10/2018 | Staedele | F04C 2/3568 |

* cited by examiner

SINUSOIDAL PUMP WITH BLOCKING SLIDE, AND PRODUCTION METHOD

CROSS-REFERENCE TO RELATED APPLICATION

This application is based on and claims the benefit of priority of the prior German Patent Application No. 10 2024 132 849.5 filed on Nov. 11, 2024, the entire contents of which are incorporated herein by reference.

BACKGROUND OF THE INVENTION

The present invention relates to a sinusoidal pump and a production method for a blocking slide for a sinusoidal pump. Sinusoidal pumps are characterised in that a rotor has a collar which extends in a radial direction and revolves in a wave-shaped or sinusoidal manner. In a pump housing, a common inlet and outlet chamber is provided in which a blocking device is formed which engages around the rotor collar and prevents backflow of the fluid to be pumped within the common inlet and outlet chamber. This blocking device can comprise a blocking slide which is placed on the rotor collar and has a slot through which the rotor collar slides.

Such slides are usually milled from a plastic blank. To seal the pump chamber, it is essential that the best possible (fluid-tight) contact between the slide and the rotor collar can be achieved. However, the milled slides only allow the production of flat contact surfaces in each case.

It is therefore an object of the present invention to provide an improved blocking device for a sinusoidal pump and an improved production method by means of which backflow of fluid to be pumped can be further reduced. It is a further object of the present invention to provide a production method for a blocking slide that can be used in pumps in the food industry.

These objects are achieved by a blocking slide, by a pump and by a production method.

According to one embodiment, a blocking slide for a pump, such as a sinusoidal pump, comprises a rotor contact area designed to rest against a wave-shaped rotor collar of the pump. The blocking slide can be a substantially cuboid component with a slot which is provided in one side and forms the rotor contact area and is designed to be placed on the rotor collar.

The rotor contact area comprises lateral rotor contact surfaces which are designed to rest against each of the side surfaces of the rotor collar, and an upper rotor contact surface which is designed to rest against a radially outward-facing shell surface of the rotor collar. The lateral and upper rotor contact surfaces thus form the aforementioned slot in the blocking slide which can be placed on the rotor collar and which is in contact with the rotor collar during operation of the pump in order to seal a pump chamber of the pump and prevent backflow of the fluid to be conveyed from an outlet region back to an inlet region.

The lateral rotor contact surfaces are each implemented as conically rounded surfaces, wherein a first radius of curvature in a lower region of the lateral rotor contact surfaces, which is remote from the upper rotor contact surface, is smaller than a second radius of curvature in an upper region of the lateral rotor contact surfaces, which is adjacent to the upper rotor contact surface. This allows to achieve a large-area contact between the lateral rotor contact surfaces and the wave-shaped rotor collar since, in the radially outwardly extending, wave-shaped rotor collar, a radially inner region has a shorter circumference and thus a greater curvature of the wave shape than a radially outer region in which the wave shape is stretched over a longer circumference.

According to another embodiment, a pump is provided with a rotor rotatable about an axis of rotation, which comprises a rotor hub and a wave-shaped revolving rotor collar extending radially from the rotor hub, with a pump housing which together with the rotor forms a pump chamber which connects a first inlet/outlet chamber with a second inlet/outlet chamber, and with a blocking device which is arranged between the first inlet/outlet chamber and the second inlet/outlet chamber and comprises a blocking slide which blocks the pump chamber in the axial direction on both sides of the rotor collar. Such a sinusoidal pump can be used in particular for conveying foodstuffs since the pump chamber can be easily cleaned and since by providing the pump chamber between a radially outer side of the rotor and a pump housing, contamination of the fluid to be pumped, for example by lubricating oil or by abrasion particles from the drive shaft or the drive unit of the pump, can be avoided.

The blocking slide has lateral rotor contact surfaces, each of which rests against the side surfaces of the rotor collar, and the blocking slide also has an upper rotor contact surface which rests against a radially outward-facing shell surface of the rotor collar. The lateral rotor contact surfaces of the blocking slide are each implemented as conically rounded surfaces, wherein a first radius of curvature of the lateral rotor contact surfaces in a radially inner region, which is close to the rotor hub, is smaller than a second radius of curvature of the lateral rotor contact surfaces in a radially outer region which is adjacent to the upper rotor contact surface. As a result, a flat contact over the entire radial extent of the rotor collar can be achieved so that the blocking slide effectively prevents unwanted backflow of fluid against the direction of flow of the pump.

According to further embodiments, the upper rotor contact surface of the blocking slide can be a concavely curved surface with a third radius of curvature corresponding to the radius of curvature of the radially outward-facing shell surface of the rotor collar. As a result, a flat contact between the blocking slide and the rotor collar and thus good sealing of the pump chamber can also be achieved at the radially outer end of the rotor collar.

According to further embodiments, a lower rotor contact surface of the blocking slide can be in contact with a radially outward-facing shell surface of the rotor hub, wherein the lower rotor contact surface of the blocking slide is a concavely curved surface with a fourth radius of curvature corresponding to the radius of curvature of the radially outward-facing shell surface of the rotor hub. As a result, improved sealing can also be achieved at the radially inner end of the blocking slide.

The blocking slide can be made of a plastic material and can comprise an outer shell and reinforcing ribs so that cavities are formed in the blocking slide. Such a blocking slide, which substantially consists of a relatively thin-walled frame, can be produced, for example, by injection moulding or 3D printing. As a result, plastic materials such as polyamide, which are only approved for use in the food industry when processed by injection moulding, can be used in some embodiments.

According to some embodiments, the outer shell and/or the reinforcing ribs of the blocking slide can be made of a plastic material with a glass fibre content, such as glass fibre-reinforced polyamide, in order to provide a blocking slide with high mechanical strength and low abrasion.

At least some of the cavities of the blocking slide can be filled with a filling material. The filling material can be, for example, the same material as that used for the blocking slide base body or, depending on the intended application, a different material that has material properties suitable for the application. The filled blocking slide can then be cleaned more easily and has no accessible cavities into which the fluid to be conveyed could penetrate. Alternatively, the cavities of the blocking slide can also remain open if it is not necessary for the intended application to provide a completely filled blocking slide.

According to another embodiment, a method for producing a blocking slide for a sinusoidal pump is provided, comprising providing a glass fibre reinforced plastic material that is suitable for processing by injection moulding and producing the blocking slide by injection moulding the glass fibre reinforced plastic material.

As explained in connection with the other embodiments, the blocking slide produced by the method according to the invention has a rotor contact area comprising lateral rotor contact surfaces which are each designed to rest against side surfaces of a rotor collar, and an upper rotor contact surface which is designed to rest against a radially outward-facing shell surface of the rotor collar. The lateral rotor contact surfaces are each implemented as conically rounded surfaces, wherein a first radius of curvature of the lateral rotor contact surfaces in a lower region, which is remote from the upper rotor contact surface, is smaller than a second radius of curvature of the lateral rotor contact surfaces in an upper region adjacent to the upper rotor contact surface.

According to a refinement, the step of producing the blocking slide by injection moulding the glass fibre reinforced plastic material can comprise producing a blocking slide with an outer shell and with at least one reinforcing rib located within the outer shell so that cavities are formed within the outer shell. As a result, an injection moulding process, which can generally only be used to produce relatively thin-walled components, can also be used to produce a blocking slide that has sufficient expansion in a depth direction to achieve good sealing of the pump chamber via large-area contact with the rotor collar. Furthermore, the method can also comprise filling the cavities in the blocking slide with a filling material to ensure that no fluid to be pumped can penetrate into the cavities in the blocking slide during operation of the pump.

According to a further aspect, a method for producing a blocking slide for a sinusoidal pump is provided, wherein a plastic material is used, wherein the plastic material is approved for food applications when processed by injection moulding, and the blocking slide is produced by injection moulding the plastic material. The blocking slide is suitably shaped to be placed on a rotor collar of a sinusoidal pump and to prevent a backflow of fluid against the direction of flow. Thus, blocking slides for sinusoidal pumps in the food sector can be produced in a simple manner by using starting materials that are only approved for use in the food sector when processed by injection moulding.

The plastic material can be a glass fibre reinforced plastic material to ensure sufficient mechanical strength of the blocking slide.

The step of producing the blocking slide by injection moulding can comprise producing a blocking slide with an outer shell and with at least one reinforcing rib inside the outer shell so that cavities are formed inside the outer shell. According to some embodiments, the cavities in the blocking slide can then be filled with a filling material so that the filled blocking slide is easy to clean.

Further features and advantages of the invention are apparent from the following description and from the drawings, to which reference is made. In the drawings.

Figure 3A:
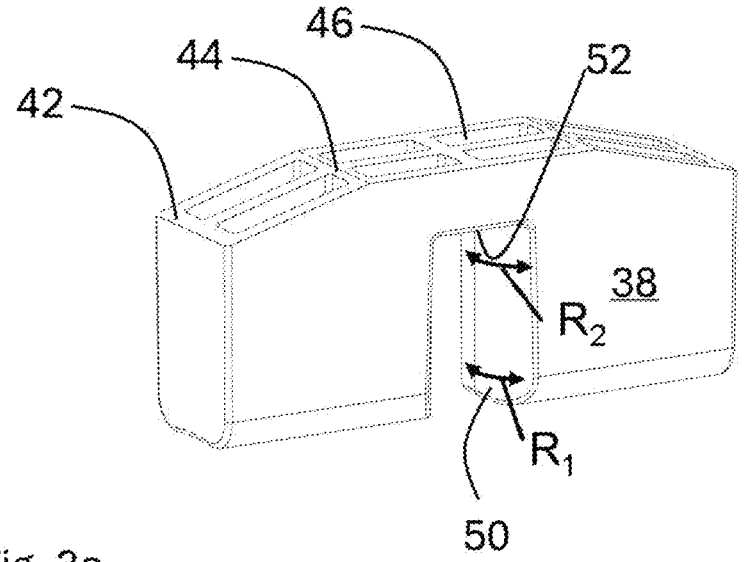
Figure 3B:
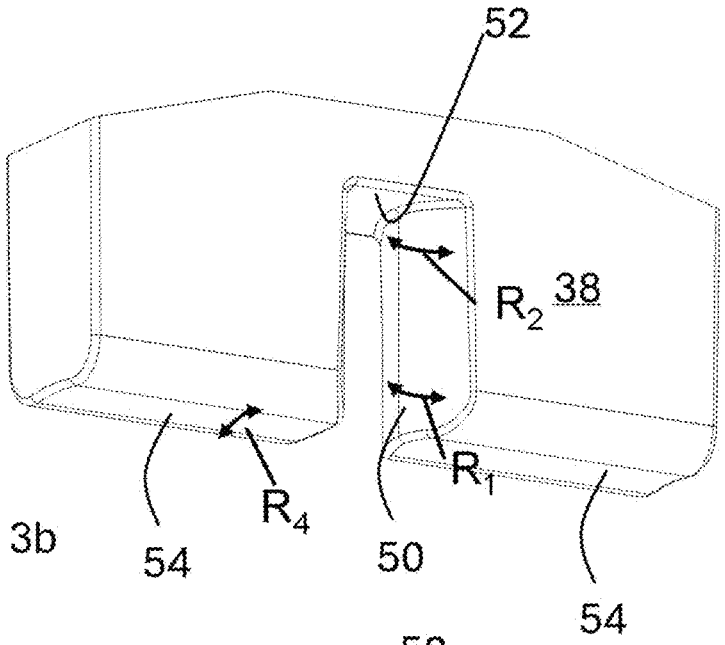

FIG. 3*a* shows a blocking slide according to an embodiment of the present invention;

FIG. 3*b* shows a further view of the blocking slide shown in FIG. 3*a;*

Figure 3C:
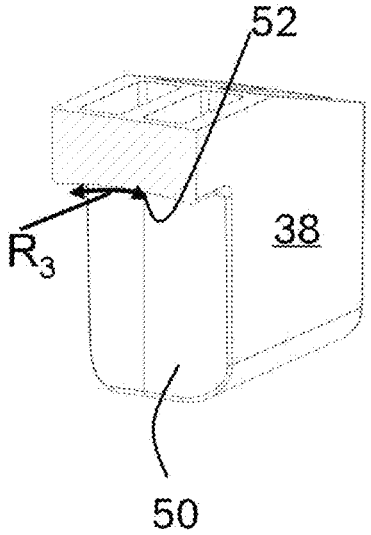

FIG. 3*c* shows a sectional view of the blocking slide of FIG. 3*a;*

Figure 1:
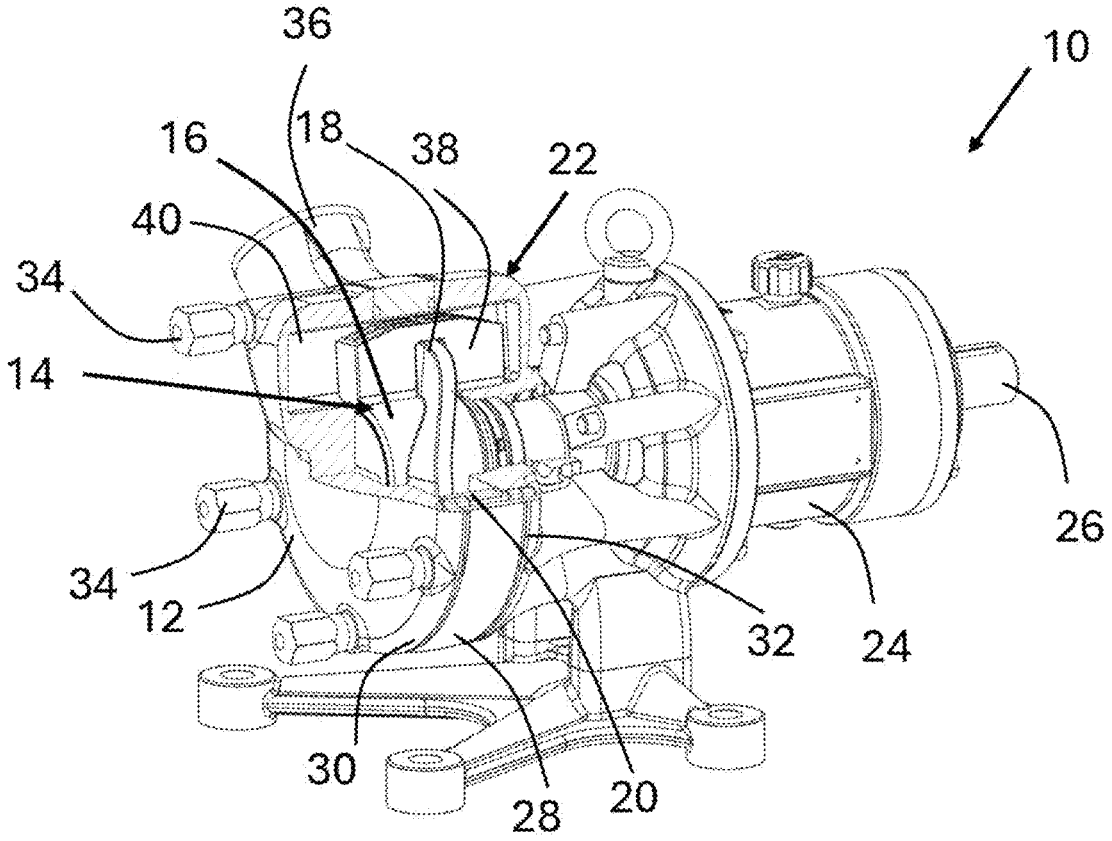
FIG. 1 shows a perspective, partially sectioned view of a pump according to the invention.
Figure 4A:
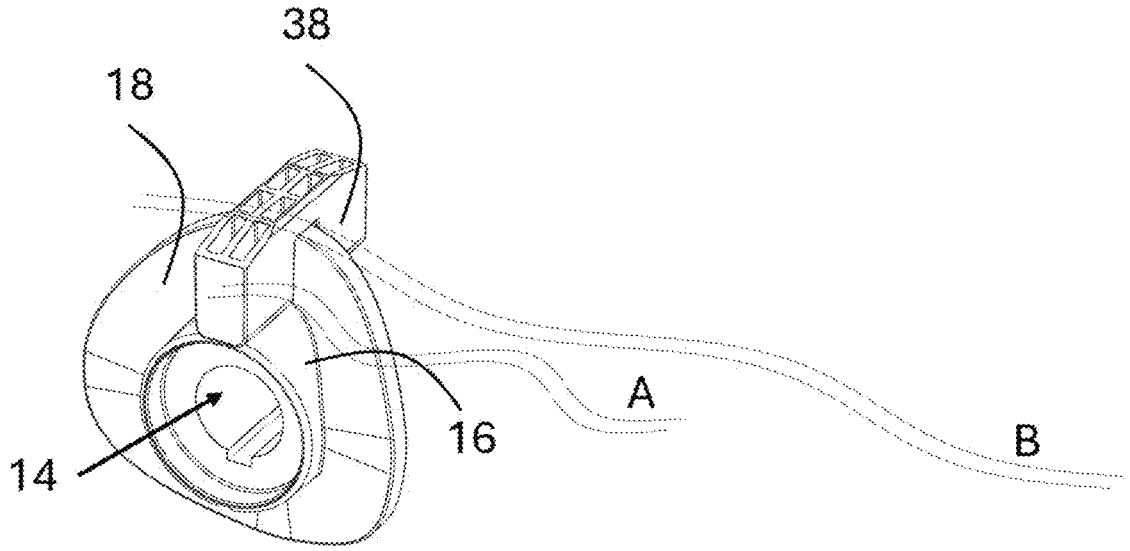
Figure 4B:
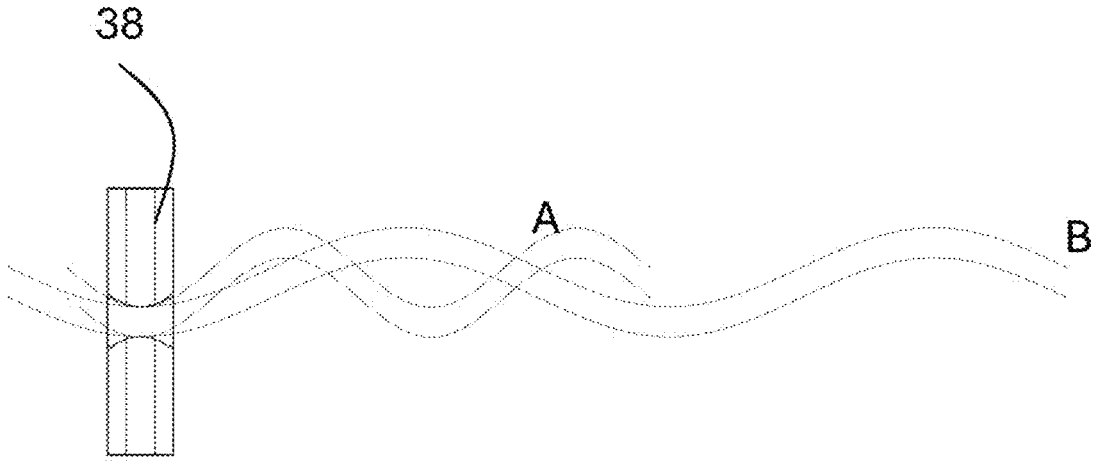
Figure 5:
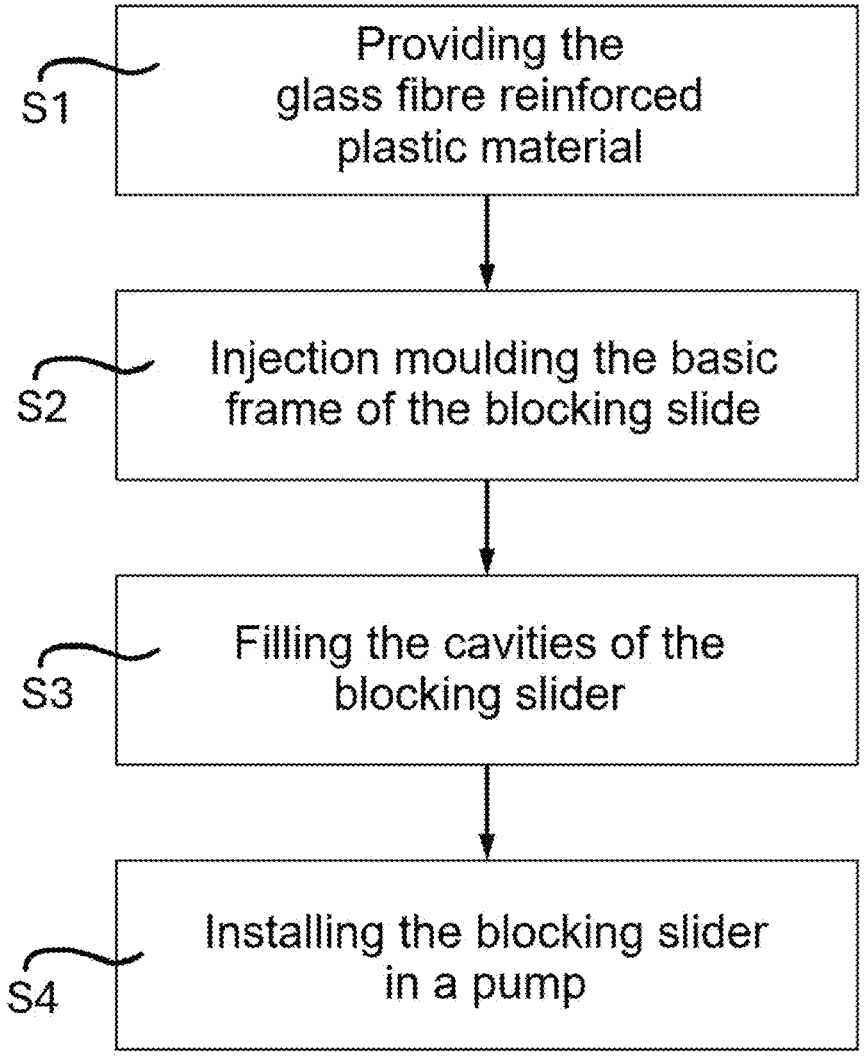

FIG. 4*a* shows a perspective illustration of the respective radii of curvature of different regions of the rotor collar in the pump shown in FIG. 1;

FIG. 4*b* shows a top view on the blocking slide shown in FIG. 3*a*, also illustrating the radii of curvature of different regions of the rotor collar of the pump shown in FIG. 1; and FIG. 5 shows a flow diagram of a production method for a blocking slide.

Figure 2:
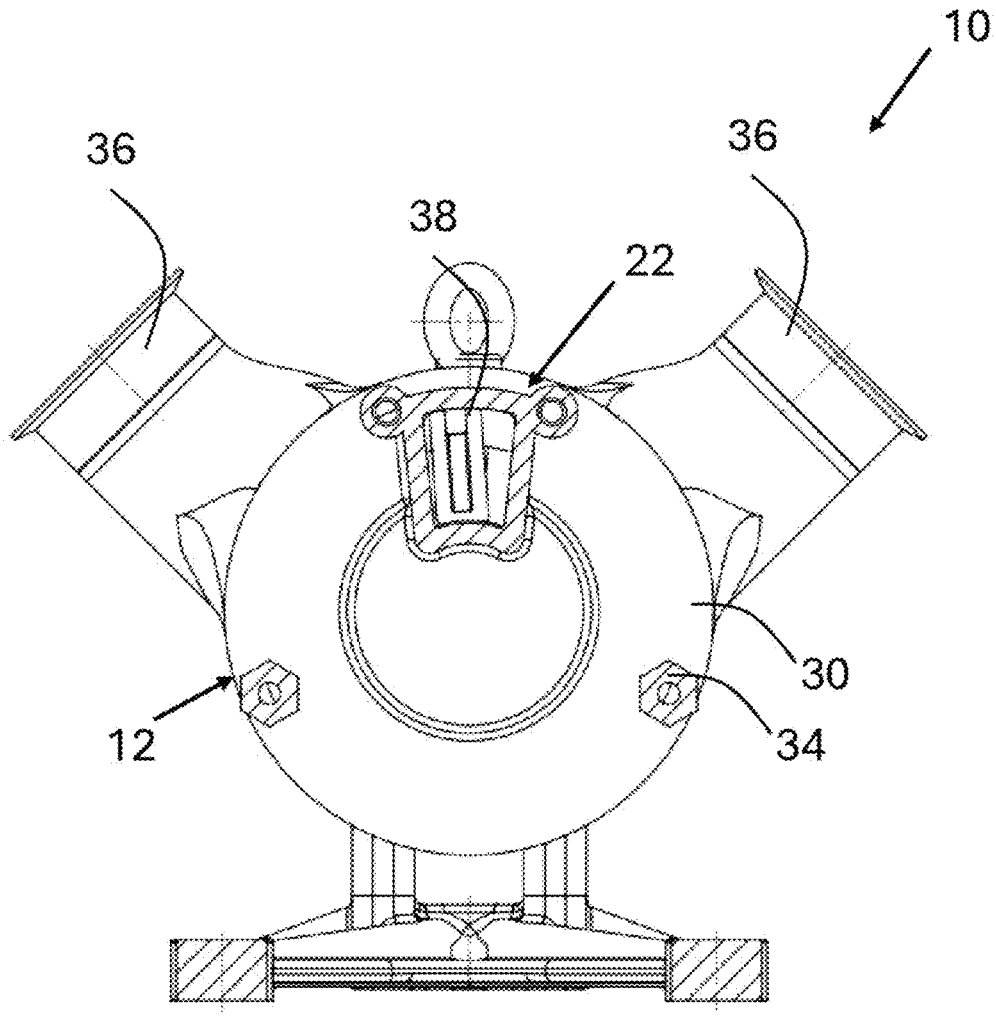
FIG. 2 shows a sectional view through the pump shown in FIG. 1.

FIGS. 1 and 2 show a pump 10 in a partially sectioned view. A rotor 14, which has a rotor hub 16 and rotor collar 18 extending in a radial direction and revolving in a wave-like manner is accommodated in an annular pump housing 12. Fluid to be pumped is thus conveyed from an inlet side to an outlet side by the rotation of the rotor 14 with the rotor collar 18 in a pump chamber 20 which is delimited by corresponding inner surfaces of the pump housing 12 and outer surfaces of the rotor hub 16 and the rotor collar 18.

A blocking device 22, which will be described in more detail below, prevents a backflow from the outlet side to the inlet side of the fluid to be conveyed.

The pump 10 further comprises a shaft bearing unit 24 in which a shaft 26 is mounted to which the rotor 14 is fastened, wherein the pump housing 12 is attached to the shaft bearing unit 24 and the shaft 26 is mounted on one side and projects into the pump housing 12.

In the following, information on an axial direction refers to the axis of rotation of the rotor 14 and information on a radial direction refers to a corresponding radial direction centred on the axis of rotation.

In the embodiment shown, the pump housing 12 comprises in each case a central annular housing component 28 and two axial housing components 30, 32, wherein the central housing component 28 and the axial housing components 30, 32 are held together by multiple screw connections 34 with respective screws, washers and nuts, wherein the screw connections 34 each extend from the shaft bearing unit 24 through all three housing components 28, 30, 32. However, a different fastening method can also be provided. For example, independent fastening of the housing components 28, 30, 32 to each other and of the pump housing 12 to the shaft bearing unit 24 can be provided, or independent fastening of the individual axial housing components 30, 32 can be provided. This enables modular assembly and disassembly of the pump 10.

The central annular housing component 28 has inlet/outlet connection elements 36, which each define inlet/outlet regions in the pump chamber 20 and to which pipes (not shown) can be connected. (see FIG. 2).

The blocking device 22 comprises a blocking slide 38 and is designed to block the pump channel 20 in the axial direction on both sides of the rotor collar 18. The blocking slide 38 is placed on the rotor collar 18 and arranged in a blocking slide chamber 40 in the pump housing 12.

FIGS. 3*a* to 3*c* each show the blocking slide 38. According to one embodiment, a blocking slide 38 is a component produced from a plastic material by means of an injection moulding process. Due to the production process, the blocking slide 38 thus comprises a frame produced by an injection moulding process with an outer shell 42 and reinforcing ribs 44 which are arranged within the outer shell 42 so that cavities 46 are formed in the injection-moulded blocking slide 38, which can be filled with a filling material (not shown).

Producing the blocking slide 38 by means of injection moulding has the advantage that, on the one hand, plastic materials such as polyamide can be processed, which are only approved for food use when processed by injection moulding, and that, on the other hand, the mechanical properties of the plastic material used can be improved, for example, by adding a glass fibre content.

When producing the blocking slide 38 by means of an injection moulding process, the shapes of the respective outer surfaces of the blocking slide 38 can also be selected in such a manner that particularly good sealing of the pump chamber 20 can be achieved when the pump 10 is in operation.

When the pump 10 is in operation, a rotor contact area 48 of the blocking slide 38 is in contact with the rotor collar 18 or the rotor hub 16 (see FIG. 1). In the case of the blocking slide 38 according to one embodiment shown in FIGS. 3*a-c*, lateral rotor contact surfaces 50, which rest against axial side surfaces of the rotor collar 18 during operation of the pump 10, are formed as conically curved shell surfaces of which in each case a first radius of curvature $R_1$ in a lower region of the lateral rotor contact surfaces 50, which during operation of the pump rests closer to a radially inner end of the rotor collar 18, is smaller than a second radius of curvature $R_2$ in an upper region of the lateral rotor contact surfaces 50, which, during operation of the pump 10, rests closer to a radially outer end of the rotor collar 18.

Thus, according to the embodiment shown in FIG. 3*a-c*, the lateral rotor contact surfaces 50 of the blocking slide 38 are not formed as sections of cylinder shell surfaces, but rather the radius of curvature of the lateral rotor contact surfaces 50 increases continuously from a lower (radially inner) end to an upper (radially outer) end of the respective lateral rotor contact surface 50. As a result, improved contact between the lateral rotor contact surfaces 50 and the side surfaces of the rotor collar 18 can be achieved, as illustrated in FIGS. 3*a-b*.

FIG. 4*a* shows the rotor 14 with the rotor hub 16 and a sinusoidal rotor collar 18 extending in the radial direction. The projections A and B in FIG. 4*a* correspond to the rolling track of a radially inner end (projection A) and a radially outer end (projection B) of the rotor collar 18. Because the circumference of the radially inner end of the rotor collar 18 is smaller than the circumference of the radially outer end of the rotor collar 18, the slope of the sine curve defining the waveform of the rotor collar 18 is higher at the radially inner end of the rotor collar 18 than at the radially outer end (see also FIG. 4*b*). The lateral rotor contact surfaces 50 of the blocking slide 38 according to the embodiment shown are therefore adapted to the curvature of the side surfaces of the rotor collar 18, which curvature decreases from the radially inner end to the radially outer end and can therefore achieve improved contact between the blocking slide 38 and the rotor collar 18 compared to cylindrical rotor contact surfaces.

The blocking slide 38 shown in FIGS. 3*a-c* further comprises an upper rotor contact surface 52 which, during operation of the pump 10, is in contact with a radially outer shell surface of the rotor collar 18. According to some embodiments, as shown in FIG. 3*c*, the upper rotor contact surface 52 can be provided as a concavely curved surface with a radius of curvature $R_3$ corresponding to a radius of curvature of the radially outer shell surface of the rotor collar 18. As a result, sealing of the pump chamber against unwanted backflow of the fluid to be conveyed can also be improved at the radially outer end of the rotor collar 18.

According to some embodiments, a lower rotor contact surface 54 of the blocking slide 38, which is in contact with a radially outer surface of the rotor hub 16 during operation of the pump 10, can also be configured as a concavely curved surface whose radius of curvature $R_4$ corresponds to a radius of curvature of the radially outer surface of the rotor hub 16. As a result, good sealing can also be achieved at the radially inner region of the pump chamber 20.

The outer contour of the blocking slide 38 outside the rotor contact area 48 is determined by the configuration of the blocking slide chamber 40 of the blocking device 22 for a specific pump 10 and can differ depending on the design and requirements of the pump 10, for example with regard to whether the pump 10 is to be operable in both directions or only in one direction, or with regard to which fluids with which viscosities are to be conveyed.

According to another embodiment of the present invention, a production method is provided, which is illustrated in FIG. 5, wherein in step S1 a glass fibre reinforced plastic material is provided. For example, polyamide 66 with a glass fibre content of 35% can be used here to increase the mechanical strength of the blocking slide and reduce abrasion during pump operation.

In step S2, a blocking slide, for example a blocking slide 38 as shown in FIG. 3*a-c*, is produced by injection moulding, wherein a relatively thin outer shell 42 and reinforcing ribs 44, which are arranged within the outer shell 42, are formed by injection moulding, so that despite the production-related limitation to relatively thin wall thicknesses in injection moulding processes, an overall mechanically stable blocking slide 38 can be formed.

The shape of the blocking slide can be freely adapted to the requirements of a respective pump model by configuring the injection moulds accordingly in order to achieve a good sealing of the pump chamber against an undesired backflow of the fluid to be conveyed, as described above with reference to FIGS. 3*a-c* and 4*a-b*, and also to adapt the outer contours of the blocking slide outside the rotor contact area to the dimensions of the pump chamber and the blocking slide chamber of a specific pump type.

In step S3, the cavities formed between the outer shell 42 and the reinforcing ribs 44 of the blocking slide 38 can then be filled with a filling material such as polyurethane, or with the same material from which the blocking slide base body is made.

Finally, in step S4, the blocking slide can be installed in a sinusoidal pump, for example by loosening the screw connections 34 of the pump housing 12 of the pump 10 shown in FIG. 1 and placing the blocking slide 38 on the rotor collar 18 and inserting it into the blocking slide chamber 40. In this manner, an improved blocking slide 38 according to the present invention can also be retrofitted to existing pumps, so that an improved sealing of the pump chamber 20 can also be achieved in existing pumps.

According to a modified embodiment, a plastic material that is not glass fibre reinforced can also be used in the production method shown in FIG. 5. Furthermore, the production method shown in FIG. 5 can also be used to produce a blocking slide of any shape that is suitable for use in a pump according to FIGS. 1 and 2.

The invention claimed is:

1. A blocking slide for a pump, comprising:

a rotor contact area designed to rest against a wave-shaped rotor collar of the pump, wherein the rotor contact area comprises:

lateral rotor contact surfaces which are designed to rest in each case against side surfaces of the rotor collar, the lateral rotor contact surfaces extending between a first face and a second face of the blocking slide, and an upper rotor contact surface which is designed to rest against a radially outward-facing shell surface of the rotor collar, wherein the lateral rotor contact surfaces are each implemented as each comprise conically rounded surfaces extending between the first face and the second face, wherein a first radius of curvature in a lower region of the lateral rotor contact surfaces, which is remote from the upper rotor contact surface, is smaller than a second radius of curvature in an upper region of the lateral rotor contact surfaces, which is adjacent to the upper rotor contact surface.

2. A pump, with a rotor which can rotate about an axis of rotation and which comprises a rotor hub and a rotor collar which extends from the rotor hub in a radial direction and revolves in a wave-like manner, a pump housing which, together with the rotor, forms a pump chamber which connects a first inlet/outlet chamber to a second inlet/outlet chamber, and a blocking device which is arranged between the first inlet/outlet chamber and the second inlet/outlet chamber and which comprises a blocking slide which blocks the pump chamber in the axial direction on both sides of the rotor collar, wherein the blocking slide has lateral rotor contact surfaces each of which rest against side surfaces of the rotor collar, the lateral rotor contact surfaces extending between a first face and a second face of the blocking slide, and has an upper rotor contact surface which rests against a radially outward-facing shell surface of the rotor collar, wherein the lateral rotor contact surfaces of the blocking slide are each implemented as each comprise conically rounded surfaces extending between the first face and the second face, wherein a first radius of curvature of the lateral rotor contact surfaces in a radially inner region, which is close to the rotor hub, is smaller than a second radius of curvature of the lateral rotor contact surfaces in a radially outer region which adjoins the upper rotor contact surface.

3. The pump according to claim 2, wherein the upper rotor contact surface of the blocking slide is a concavely curved surface with a third radius of curvature which corresponds to the radius of curvature of the radially outward-facing shell surface of the rotor collar.

4. The pump according to claim 2, wherein a lower rotor contact surface of the blocking slide is in contact with a radially outward-facing shell surface of the rotor hub, and wherein the lower rotor contact surface of the blocking slide is a concavely curved surface with a fourth radius of curvature, which corresponds to the radius of curvature of the radially outward-facing shell surface of the rotor hub.

5. The pump according to claim 2, wherein the blocking slide is made from a plastic material and comprises an outer shell and reinforcing ribs so that cavities are formed in the blocking slide.

6. The pump according to claim 5, wherein at least one of the outer shell and and/or the reinforcing ribs of the blocking slide are made from a plastic material with a glass fibre content, such as glass fibre-reinforced polyamide.

7. The pump according to claim 4, wherein at least some of the cavities of the blocking slide are filled with a filling material.

8. A method for producing a blocking slide for a sinusoidal pump, comprising:

providing a glass fibre reinforced plastic material suitable for processing by injection moulding;

producing the blocking slide by injection moulding the glass fibre reinforced plastic material, wherein the blocking slide has a rotor contact area, comprising:

lateral rotor contact surfaces which are designed to rest in each case against side surfaces of a rotor collar, the lateral rotor contact surfaces extending between a first face and a second face of the blocking slide, and an upper rotor contact surface, which is designed to rest against a radially outward-facing shell surface of the rotor collar, wherein the lateral rotor contact surfaces are each implemented as each comprise conically rounded surfaces extending between the first face and the second face, wherein a first radius of curvature of the lateral rotor contact surfaces in a lower region, which is remote from the upper rotor contact surface, is smaller than a second radius of curvature of the lateral rotor contact surfaces in an upper region which is adjacent to the upper rotor contact surface.

9. The method according to claim 1, wherein the step of producing the blocking slide by injection moulding the glass fibre reinforced plastic material comprises producing a blocking slide having an outer shell and having at least one reinforcing rib located within the outer shell so that that cavities are formed within the outer shell, and wherein the method further comprises:

filling the cavities in the blocking slide with a filling material.

10. A method for producing the blocking slide for the pump of claim 1, comprising:

providing a plastic material suitable for processing by injection moulding, wherein the plastic material is approved for food applications when processed by injection moulding;

producing the blocking slide by injection moulding the plastic material.

11. The method according to claim 10, wherein the plastic material is a glass fibre reinforced plastic material.

12. The method according to claim 10, wherein the step of producing the blocking slide by injection moulding comprises producing a blocking slide having an outer shell and having at least one reinforcing rib located within the outer shell so that that cavities are formed within the outer shell, and wherein the method further comprises:

filling the cavities in the blocking slide with a filling material.

* * * * *